US008839955B1

(12) United States Patent
Klinsport et al.

(10) Patent No.: US 8,839,955 B1
(45) Date of Patent: Sep. 23, 2014

(54) MULTI-PURPOSE ITEM PROTECTOR AND METHODS OF PRODUCTION THEREOF

(75) Inventors: Susan Klinsport, Vero Beach, FL (US); John P. Alber, Vero Beach, FL (US); Stanley R. Kellenberger, Appleton, WI (US)

(73) Assignee: E4 Technologies Incorporated, Vero Beach, FL (US)

( * ) Notice: Subject to any disclaimer, the term of this patent is extended or adjusted under 35 U.S.C. 154(b) by 60 days.

(21) Appl. No.: 12/950,576

(22) Filed: Nov. 19, 2010

Related U.S. Application Data

(60) Provisional application No. 61/262,967, filed on Nov. 20, 2009.

(51) Int. Cl.
*B65D 83/10* (2006.01)

(52) U.S. Cl.
USPC ..... 206/362.2; 206/439

(58) Field of Classification Search
USPC ..... 206/361, 362.2–362.4, 439, 484–484.2, 206/438; 383/42, 95, 113; 128/206.19
See application file for complete search history.

(56) References Cited

U.S. PATENT DOCUMENTS

| | | | | |
|---|---|---|---|---|
| 3,978,553 | A | 9/1976 | Honig | 24/7 |
| 3,991,881 | A * | 11/1976 | Augurt | 206/439 |
| 4,153,091 | A * | 5/1979 | Jahn | 383/95 |
| 4,203,520 | A * | 5/1980 | Schuster | 206/439 |
| 4,276,982 | A * | 7/1981 | Sibrava et al. | 206/439 |
| 4,800,108 | A | 1/1989 | Swartz | 428/43 |
| 5,012,805 | A * | 5/1991 | Muckerheide | 128/206.19 |
| 5,073,457 | A | 12/1991 | Blackwell | 428/484 |
| 5,139,142 | A | 8/1992 | Simon | 206/362.3 |
| 5,222,600 | A * | 6/1993 | Stoddard et al. | 206/439 |
| 5,459,978 | A * | 10/1995 | Weiss et al. | 206/439 |
| 5,699,791 | A * | 12/1997 | Sukiennik et al. | 128/206.19 |
| 5,706,804 | A * | 1/1998 | Baumann et al. | 128/206.19 |
| 5,730,530 | A * | 3/1998 | Stoddard et al. | 206/439 |
| 5,771,521 | A * | 6/1998 | McNamee | 206/362.3 |
| 5,998,308 | A | 12/1999 | Cohen | 442/110 |
| 6,406,674 | B1 * | 6/2002 | Bourne et al. | 206/439 |
| 6,406,764 | B2 * | 6/2002 | Bayer | 206/439 |
| 6,517,916 | B1 * | 2/2003 | Bayer et al. | 206/439 |
| 6,986,730 | B1 * | 1/2006 | Hoekstra | 206/439 |
| 2008/0202960 | A1 * | 8/2008 | Donohue | 206/362.3 |
| 2008/0237410 | A1 | 10/2008 | Neuberger et al. | 248/110 |
| 2010/0044271 | A1 | 2/2010 | McMillan | 206/553 |

* cited by examiner

*Primary Examiner* — Bryon Gehman
(74) *Attorney, Agent, or Firm* — William G. Giltinan; Carlton Fields Jorden Burt, PA

(57) ABSTRACT

A preferably disposable item protector having a first and second layer, sealed peripheral edges, and an opening to provide access to the interior, formed of material substantially permeable to vapor and substantially impermeable to liquid and microbial contaminants. A method of producing such item protectors comprising the steps of folding a continuous strip of material, bonding the peripheral edges with adhesives, sonic bonding, heat bonding, or other techniques, and cutting the material proximate to the bonded edges to release the item protectors.

9 Claims, 5 Drawing Sheets

MULTI-PURPOSE ITEM PROTECTOR AND METHODS OF PRODUCTION THEREOF

PRIOR APPLICATIONS

This application claims priority from U.S. provisional patent application Ser. No. 61/262,967 filed Nov. 20, 2009, which is herein incorporated by reference in its entirety.

BACKGROUND

Disclosed are an antibacterial item protector and methods for production thereof. By placing toothbrushes or other items in the Item Protector before or between uses, the item is protected from contamination by microbes, thereby making the item protector suitable for use wherever sanitary conditions are not known to exist. The item protector is preferably constructed of materials that are permeable to vapors so that enclosed items may dry, but substantially impermeable to liquids which can carry contaminants. The item protector also preferably has antibacterial properties and/or is constructed of material that will act as a barrier to microbial entities. The item protector is preferably disposable.

Embodiments of item protectors according to the present invention may be produced by at least two methods. One method comprises producing item protectors by bonding two separate sheets of material together. An alternative method comprises folding a single sheet of material at least once and then bonding the material in predetermined locations such that the edge of the protector comprises the fold in addition to the bonded areas. Both methods comprise a bonding step and result in item protectors in the form of a pouch or pocket with an opening adapted to allow access to the interior. Suitable methods of bonding comprise ultrasonic bonding, heat bonding, and the use of adhesives or cohesive. Where multiple item protectors are formed at once, a cutting step may also be employed to separate the completed protectors.

Item protectors according to embodiments of the present invention are suitable for use in environments including, but not limited to, hospitals, restaurants, hotels, luggage, purses, private residences, and bathrooms, and provide a safe, sanitary (alternatively antibacterial) container for placement of such items as syringes, toothbrushes, lipsticks, forks, knives, spoons, multi-purpose utensils, and the like. Preferably, embodiments of the protector of the present invention are capable of at least enveloping the working surface (such as the bristles of a toothbrush) of items (especially personal grooming items) between uses, thereby preventing those working surfaces from coming into contact with potentially contaminated surroundings.

Public health and well being provides significant challenges in maintaining contaminant-free environments. Effective methods and standards for cleaning wash rooms, medical areas, and other contamination-prone areas are difficult to enforce and determination of compliance with such methods via visual inspection is impractical. Wiping surfaces and items with towels and disinfectant wipes can often exacerbate those challenges as the towels and wipes can transport contaminants and microorganisms from one surface to another.

Clinical studies have confirmed that harmful and even deadly microorganisms can incubate on common items such as toothbrushes kept in such environments. These studies have encompassed testing of multiple types of bacteria, yeast and viruses including those capable of causing diseases of the mouth, potentially capable of affecting the health of the entire human anatomy.

Microorganisms can be everywhere in our environment and can thrive in cool dark places, just the type of places people store items such as toothbrushes. For example, moist toothbrushes left side by side in a medicine cabinet may provide a breeding ground for germs and viruses. In such environments, microorganisms such as cold and flu viruses and bacteria associated with gingivitis can travel from brush to brush. In fact, the bathroom in general can be one of the most infectious environments in the household. It is typically high in humidity and is subject to a multitude of airborne microorganisms, including those that may be dispersed with each flush of a toilet. Chemical treatments, dishwashing, boiling, autoclaving and even microwaving is typically either ineffective at killing large numbers and groups of microorganisms or renders items such as toothbrushes unusable. Special disinfecting equipment for such items is available, but is expensive.

The ability for a person to store items like their toothbrush in a reduced-germ environment, therefore, is desirable. The present invention seeks to address this need by providing an economical multi-purpose protector (and methods of producing the same) that is adapted to provide a place that provides a barrier between potentially unsanitary surroundings and is suitable for use with items such as, but not limited to, syringes, toothbrushes, lipsticks, & utensils.

SUMMARY

An item protector comprising a first layer and a second layer closed on said first and second layers' peripheral edges except for an opening is disclosed. The opening is adapted to provide access to the interior of the item protector. At least one of said first layer and said second layer are substantially permeable to vapor and substantially impermeable to microbes and liquids. As a result, the first layer and second layer form a pocket adapted to receive items and protect said items from contaminants.

In addition, methods of forming item protectors comprising a first layer and a second layer closed on said first and second layers' peripheral edges except for an opening providing access to the interior of the item protector are disclosed. One such method allows for applying an adhesive material to predetermined areas on a continuous strip of material, folding the material such that the fold and the predetermined areas of adhesive material form said peripheral edges, and cutting the folded material proximate to said predetermined areas of adhesive material to separate the item protectors. Another such method allows for applying an adhesive material to predetermined areas on a continuous strip of material, folding the material with a first fold and second fold such that the first fold and said second fold are substantially parallel to each other and to the lengthwise axis of the continuous strip, and such that said first fold, said second fold, and said predetermined areas of adhesive material form the peripheral edges of the item protectors, and cutting the folded material proximate to the predetermined areas of adhesive material and between said first fold and said second fold. In this way item protectors are formed in two substantially parallel strips with the first fold and said second fold being substantially opposite the item protector openings. As an alternative to using adhesives, other bonding techniques can be used to form the closed peripheral edges.

BRIEF DESCRIPTION OF DRAWINGS

Other features of the apparatus and method of the present invention will become apparent from the attached drawings, which illustrate various embodiments and certain preferred embodiments wherein

FIG. 3 illustrates a perspective view of an embodiment of the item protector of the present invention with a toothbrush inside and a flap tucked in;

DESCRIPTION OF PREFERRED EMBODIMENTS

While the following describes preferred embodiments of the apparatus and method of the present invention, it is to be understood that this description is to be considered only as illustrative of the principles of the invention and is not to be limitative thereof. Numerous other variations, all within the scope of the present invention, will readily occur to others. Herein, the term "adapted" shall mean sized, shaped, configured, dimensioned, oriented and arranged as appropriate.

Figure 1:
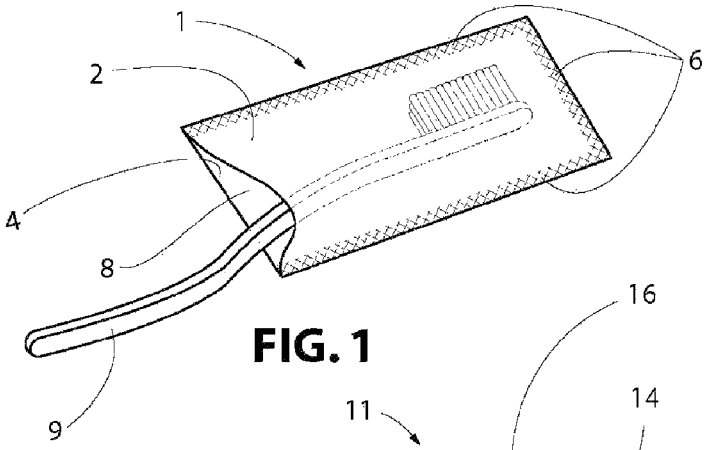
FIG. 1 illustrates a perspective view of an embodiment of the item protector of the present invention protecting the working end of a toothbrush.

Referring to FIG. 1, a preferred embodiment of an item protector 1 encloses an item 9, in this case a toothbrush. Item protector 1 is adapted such that the bristle end of item/toothbrush 9 may be placed into item protector 1 through opening 8, which provides access to item protector's 1 interior. Item protector 1 is comprised of a first layer 2 and a second layer 4. First layer 2 and second layer 4 are closed on their peripheral edges 6, except for opening 8 on one end. In this way first layer 2 and second layer 4 of item protector 1 form a pocket adapted to receive toothbrush/item 9, and protect it from contaminants. In an alternative embodiment (not shown), second layer 4 may extend beyond opening 8 to form a short flap (not shown) to advantageously facilitate ease of inserting item 9.

Peripheral edges 6 may be formed by folding, as is discussed further below, or by any of a variety of bonding methods known to those of ordinary skill in the art, including adhesives, cohesive, ultrasonic bonding, heat bonding, stitching and crimp bonding. The material from which at least one of first layer 2 and second layer 4 are formed is preferably substantially permeable to vapor, thereby allowing item/toothbrush 9 to dry while within item protector 1. The material from which first layer 2 and second layer 4 are formed is also preferably substantially impermeable to microbes and liquids, thereby offering item/toothbrush 9 protection from contamination in the event item protector 1 is placed on a less than sanitary surface. Materials exhibiting such characteristics are known, including without limitation, breathable films (such as, and also without limitation, (i) monolithic Pebax Breathable Film available from ARKEMA, Colombes, France, or (ii) Monolithic film available from Clopay Plastic Products Co., Mason, Ohio, which may, if desired, be laminated to a suitable nonwoven such as a low (circa 10-30 gsm) basis weight polypropylene spunbond or microporous breathable film such as MicroPro film also available from Clopay Plastic Products Co., which may also be laminated to a suitable nonwoven for additional strength or cost considerations or even fabrics such as Gore-Tex available from W. L. Gore & Associates, Inc., Elkton, Md.), meltblown nonwoven material (such as 35 gsm Dual Textured Polypropylene Meltblown available from Kimberly-Clark Corp., Roswell, Ga. or a custom made meltblown available from Monadnock Non-Wovens, LLC, Mount Pocono, Pa.), spunbond-meltblown nonwoven material (available from such companies as Polymer Group Inc., Charlotte, N.C. and Kimberly-Clark Corp., Roswell, Ga.), and spunbond-meltblown-spunbond nonwoven material (such as 76 gsm polypropylene SMS product code W502FWH available from Polymer Group Inc., Waynesboro, Va.), as well as other materials known in the art. Breathable films, such as those used in breathable diapers, may be used. Alternatively, a fibrous web with a microporous layer may be used, such as those used in the manufacture of medical protective wear. Preferably, materials that are hydrophobic will be utilized as such materials help to eliminate potential moist breeding areas for bacteria and microbes. Suitable hydrophobic materials include hydrophobic polymers such as acrylics, amides and imides, carbonates, dienes, esters, fluorocarbons olefins, vinyl esters and the like. Suitable methods of bonding peripheral edges 6, and in the case of adhesives and cohesive the choice of suitable bonding materials, will vary depending on the material chosen, but will be understood by those of skill in the art.

In order to maintain light weight while still providing adequate strength, a material of an appropriate basis weight should be used. In certain preferred embodiments, spunbond-meltblown-spunbond nonwoven material having a basis weight between 20 gsm and 100 gsm may be used, with material having a basis weight between 30 gsm and 90 gsm or between 40 gsm and 80 gsm being preferred. In the preceding examples, the ranges are inclusive of their respective endpoints with "gsm" being understood to refer to grams per square meter of material.

Figure 2:
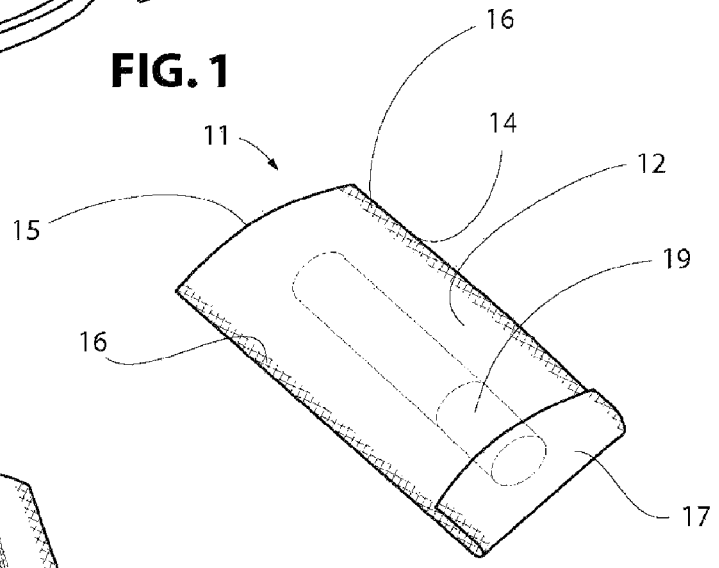
FIG. 2 illustrates a perspective view of an embodiment of the item protector of the present invention with a sealable tab protecting a tube of, for example, lip balm.

FIG. 2 illustrates an alternate preferred embodiment of the item protector of the present invention in which item protector 11 comprises first layer 12 and second layer 14, which were formed by folding material along fold 15 and bonding peripheral edges 16 as is described above. The embodiment in FIG. 2 further comprises a flap 17 which may be used to seal an item 19, as illustrated a tube of lip balm, within item protector 11. Flap 17 may optionally further comprises an adhesive area adapted to detachably secure flap 17 in a closed position. In this way, flap 17 may be closed and then later opened to allow access to item/lip balm 19, and then closed again. A variety of adhesive materials known in the art may be used, including pressure sensitive adhesives such as, without limitation, those available from HB Fuller Company, St. Paul, Minn., Bostik, Inc., Wauwatosa, Wis., and 3M Corporation, St. Paul, Minn. The adhesive may also be a cohesive such as, without limitation, that available from VALPAC, Inc., Federalsburg, Md. provided that an additional section of cohesive material is applied to first layer 12 in a location adapted to facilitate engagement with a section of cohesive material (not illustrated) on flap 17, whereby item protector 11 is substantially sealed. In this specification, unless otherwise stated it is understood that the term "adhesive" is used broadly and generally refers to both adhesive and cohesive materials.

Figure 3:
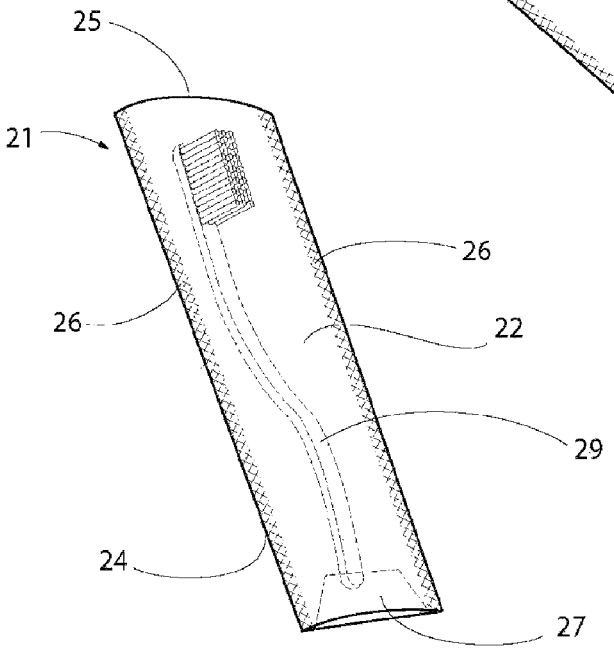

An alternative embodiment of the item protector of the present invention is illustrated in FIG. 3, in which item protector 21 comprises first layer 22 and second layer 24, which are formed by folding material about fold 25, and then closing peripheral edges 26 by bonding them as has been described. In this way a pocket or pouch is formed in which an item 29, in this case a toothbrush, may be stored. Flap 27 may be formed in second layer 24, allowing item protector 21 to be substantially sealed by tucking flap 27 in after item/toothbrush 29 has been inserted. While an adhesive might be used on the outside of flap 27 to improve sealing in such embodiments, where flap 27 is tucked in, adhesives are not required. Alternatively, adhesives may be used as described in reference to FIG. 2 and flap 17 may then be detachably fastened on the outside of first layer 22.

While the nature of the material used to form first layers 2, 12, 22 and second layers 4, 14, 24 serve to protect items 9, 19, 29 from contamination, the effectiveness of item protectors 1, 11, 21 may be enhanced if at least one of first layer 2, 12, 22 and second layer 4, 14, 24 further comprise an antimicrobial agent (not illustrated). Antimicrobial agents, which herein include antibacterial and anti-viral agents, and act to kill or prevent the growth and spreading of germs, viruses and bacteria. By coating or impregnating at least one of, and preferably both of, first layers 2, 12, 22 and second layers 4, 14, 24 with such an agent, the effectiveness of item protectors 1, 11, 21 may be enhanced as the antibacterial agent can help eliminate and prevent the spreading of germs, viruses and bacteria already present on items 9, 19, 29 when those items are placed into item protectors 1, 11, 21. Acceptable antibacterial agents include those available from suppliers such as Aegis Environmental Management, Inc. and Microban International, Ltd, as well as others known in the art. Such antimicrobial agents may be applied through a variety of methods including, without limitation, using a flexographic printing press and subsequent curing in an oven or by ultraviolet radiation, or simply by spraying the substance onto the material of which first layers 2, 12, 22 or second layers 4, 14, 24 are formed. Antimicrobial agents may also be incorporated into such materials during the manufacturing process of the material prior to it being formed into item protectors 1, 11, 21. Where item protector 1, 11, 21 is to be used in such a way that the working end of an item such as a toothbrush will come into contact with both the antimicrobial agent and the human body, is it important that the antimicrobial material be safe for such use. It is also preferred that it be adapted so as not to transfer to such items during use and/or to be substantially odorless and tasteless in the concentrations utilized. This prevents the use of the item protector 1, 11, 21 from detracting from experience of using item 9, 19, 29.

Figure 4:
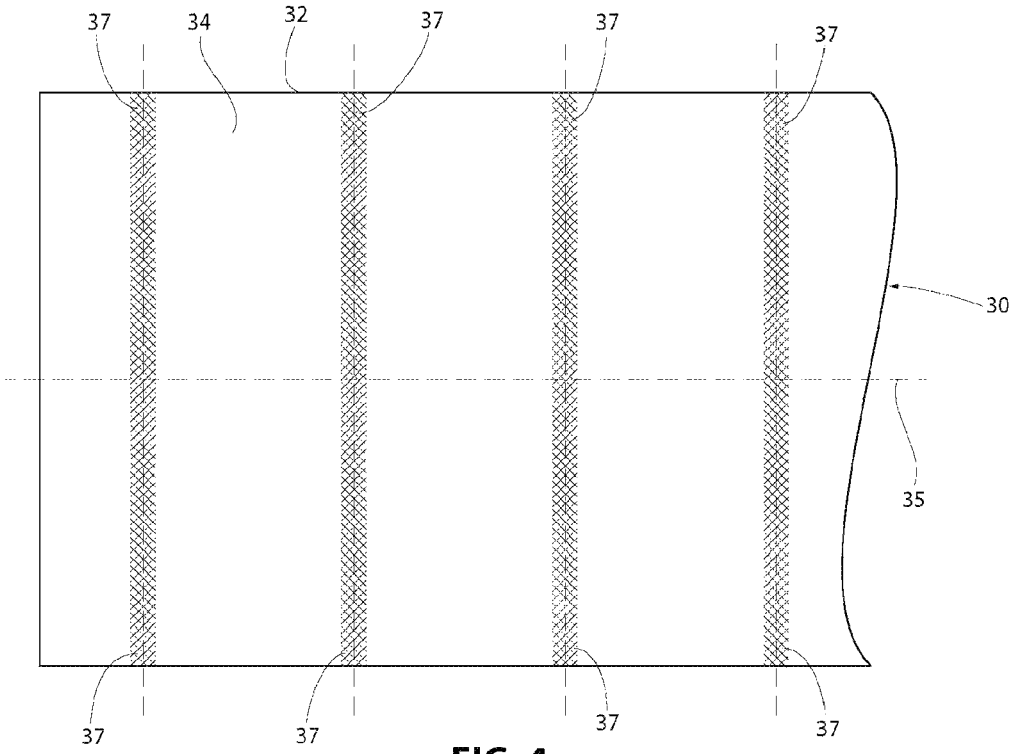
FIG. 4 illustrates a perspective view of an embodiment of the item protector of the present invention, manufactured according to an embodiment of the method of the present invention, in which the item protectors are formed by U-folding the material, bonding the folded material at predetermined locations, and then cutting proximate to such bonds in order to separate the item protectors
Figure 5:
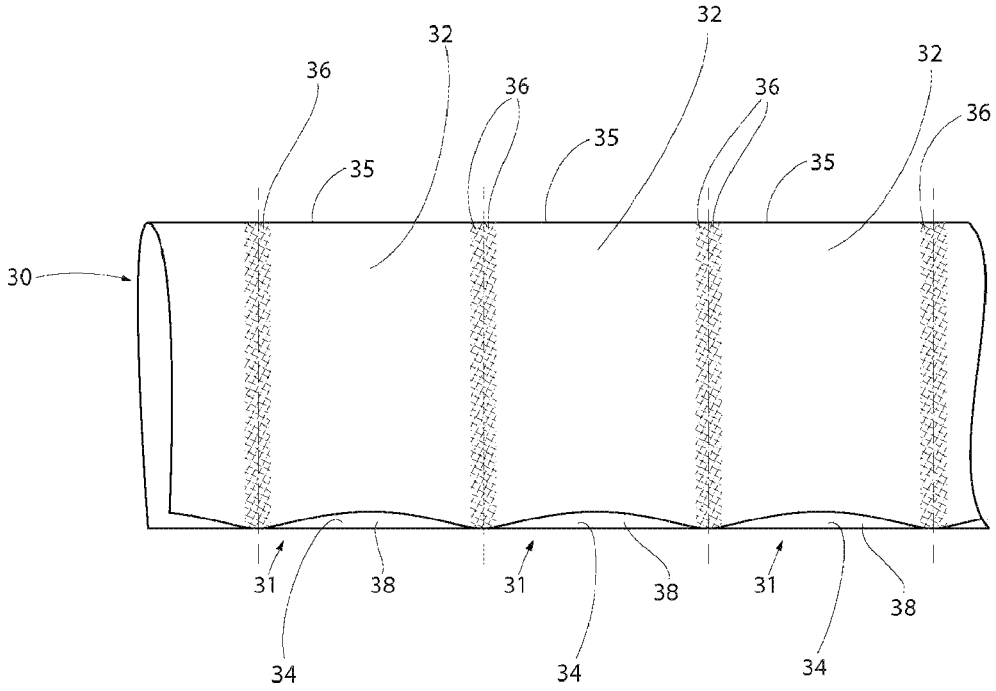
FIG. 5 illustrates a perspective view of the embodiment of FIG. 4 after folding has been performed.

Item protectors 1, 11, 21 as described above may be formed utilizing various methods. Referring to FIGS. 4-5, one such method comprises utilizing a continuous strip of material 30 having a first side 32 and a second side 34. An adhesive material (not illustrated) may be applied to at least some of predetermined areas 37. Material 30 may then be folded about fold point 35 such that opposing predetermined areas 37 meet, whereby the adhesive material secures predetermined areas 37 together. Item protectors 31 may then be separated by cutting folded material 30 proximate to predetermined areas 37. In this way, peripheral edges 36 of item protectors 31 are formed. Variations on the method of the present invention will now be readily apparent to those of skill in the art. In particular, and without limitation, the adhesive material may be applied to all of predetermined areas 37 such that adhesive material meets adhesive material upon folding, or may be applied such that a predetermined areas 37 having adhesive material comes into contact with an area that does not have adhesive material upon folding. Similarly, it will be understood that the adhesive material may be applied in a continuous area and such area may be cut substantially in its center, or may be applied in discrete strips with the cut being made between such strips. Cutting the folded material 30 proximate to said predetermined areas of adhesive material will be understood to encompass cutting through the adhesive material and cutting close to or between strips of adhesive material.

Figure 6:
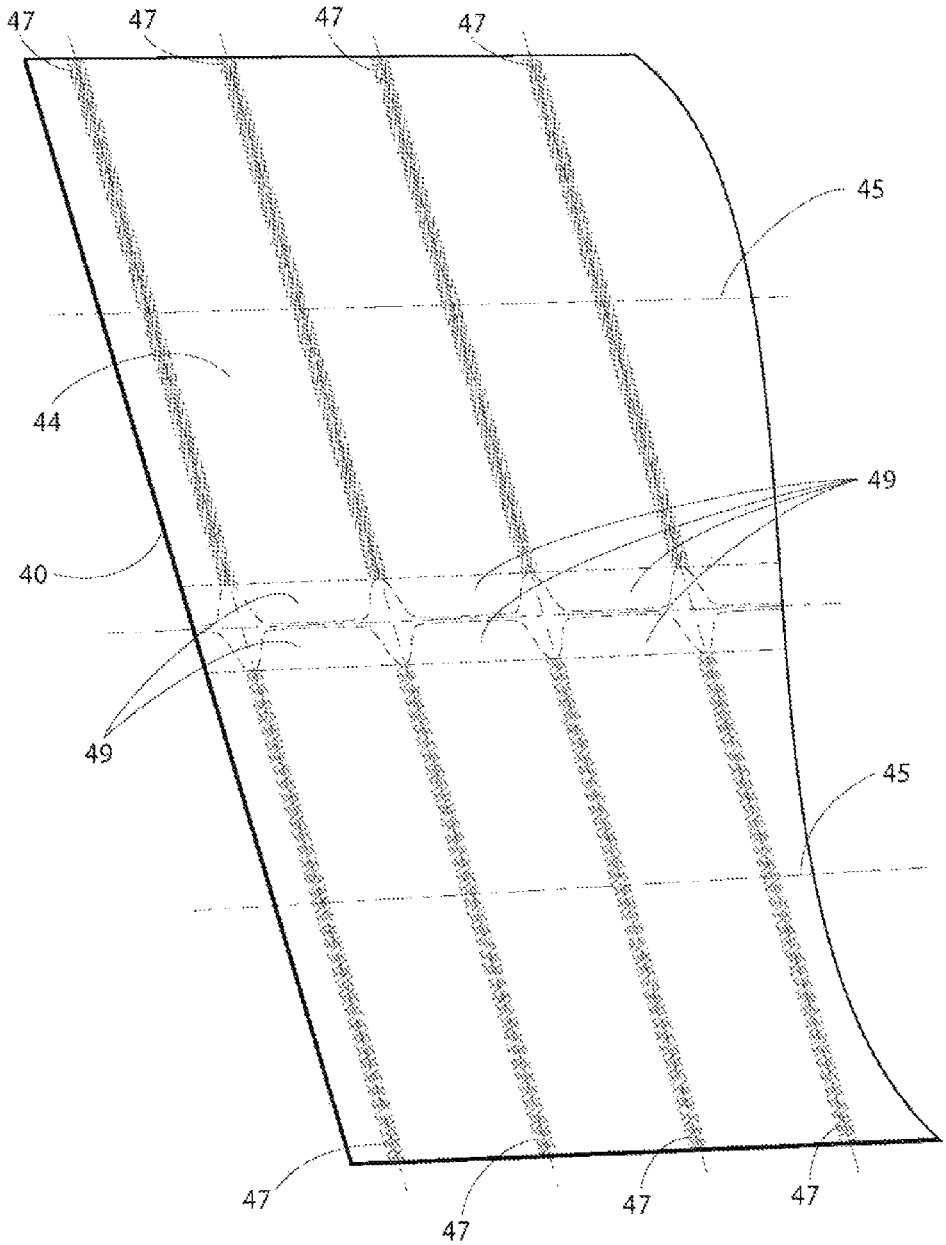
FIG. 6 illustrates a perspective view of a an embodiment of the item protector of the present invention, manufactured according to an embodiment of the method of the present invention, in which the item protectors are formed by C-folding the material, bonding the folded material at predetermined locations, and then cutting proximate to such bonds in order to separate the item protectors.
Figure 7:
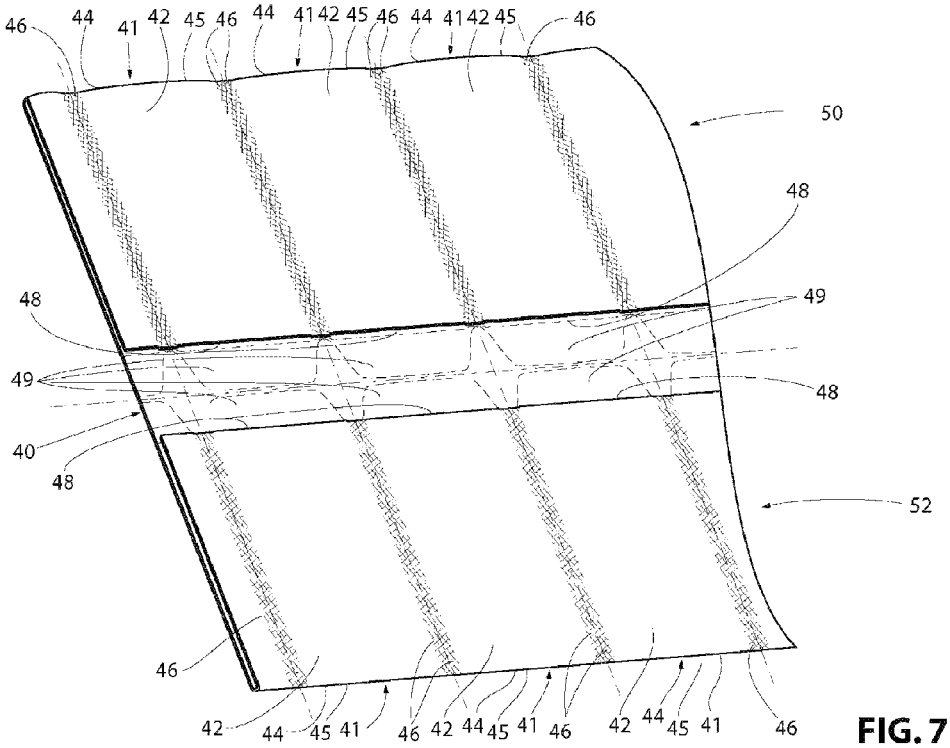
FIG. 7 illustrates a perspective view of the embodiment illustrated in FIG. 6 after folding has been performed.

FIGS. 6-7 illustrate a further method of forming item protectors according to the present invention. An adhesive material (not illustrated) may be applied to at least some of predetermined areas 47. Material 40 may then be folded about fold points 45 such that opposing predetermined areas 47 meet, whereby the adhesive material secures predetermined areas 47 together. Item protectors 41 may then be separated by cutting folded material 40 proximate to predetermined areas 47. In this way, peripheral edges 46 of item protectors 41 are formed. In the embodiments illustrated, two folds are used to form two substantially parallel strips 50, 52 of item protectors 41, with folds 45 being substantially opposite openings 48 of item protectors 41. As was discussed above, a flap 49 with or without adhesive may be used to close item protectors 41. By folding material 40 such that a single-layer area remains, flap 49 can be formed during manufacture by cutting as indicated in the figure. If an adhesive is used, one or more strips of adhesive may be applied to flap 49, and/or first layer 42, during manufacture. It should be noted that, regardless of whether a flap is formed or not, it is preferred that the cuts be made through only a single layer of material 40 at or near opening 48 as, where opening 48 to be formed by cutting through two layers, the cutting process may cause the thermoplastic material to stick together, thereby making it difficult to insert items into item protector 41.

It is further noted that, with respect to embodiments using a single fold, including the embodiments illustrated in FIGS. 4-5, a flap (not illustrated) may be formed by folding the material 30 such that the fold 35 is offset from the center of the lengthwise direction of material 30. An adhesive (not illustrated) may then be applied to the formed flap (not illustrated) allowing the item protector 31 to be sealed by folding the flap over the opening such that the adhesive material detachably secures the flap. Optionally, the flap thus formed may also be trimmed to allow for tucking in as has been described above.

As has been discussed above, the effectiveness of the embodiments illustrated in FIGS. 4-7 may preferably be improved by application of a material having antimicrobial properties to material 30, 40 during manufacture. Although said material is preferably applied to the surface that will become the inside surface of item protectors 31, 41, it can also, or alternatively, be applied to the outside surface depending on the application. Such material may be impregnated into material 30,40 during manufacture of the material itself, or may be applied by a variety of means known to those in the art, including those discussed elsewhere herein, during the formation of item protectors 31, 41, including without limitation by spraying or otherwise applying the antimicrobial substance onto material 30, 40 prior to folding.

While the embodiments illustrated in FIGS. 4-7 have been discussed with respect to the use of adhesives applied to predetermined areas 37, 47, other bonding means may also be used. In particular, after folding predetermined areas 37, 47 may be heat bonded, sonically bonded, crimped, or otherwise sealed utilizing a variety of techniques understood by those of skill in the art. Additionally, it is possible that, instead of cutting item protectors 31, 41 completely to separate them, perforations may be used such that item protectors 31, 41 may be delivered in a supply, and torn off as needed. The result being a supply of low cost, preferably disposable item protectors that may be used one or two times and then disposed of. Having item protectors that are disposable is advantageous because, after repeated uses, the interiors of such item protectors can become contaminated. By providing a low cost item protector that is disposable, this problem can easily be avoided by simply discarding a used item protector after a small number of uses.

Although exemplary embodiments of the present invention have been shown and described, it will be appreciated by those skilled in the art that changes might be made in these embodiments without departing from the principles and spirit of the invention, the scope of which is defined in the claims and their equivalents. In particular, many combinations of materials may be used to achieve suitable results including various adhesives, cohesive, and antimicrobial materials. Item protectors of the present invention may also be made in a variety of ways. It is not intended that the description of embodiments herein be limiting.

We claim:

1. A reusable toothbrush head protector comprising a single generally rectangular sheet of fabric having a length that is more than two times its width;

said sheet being folded across its width to create a first facing panel and a second facing panel;

said second facing panel overlapping said first facing panel such that a flap is formed by the excess length of said second facing panel;

each of said first facing panel and said second facing panel having a first side edge substantially perpendicular to the fold created by said sheet being folded across its width, and a second side edge substantially parallel to said first side edge;

said first side edge of said first facing panel being bonded to said first side edge of said second facing panel;

said second side edge of said first facing panel being bonded to said second side edge of said second facing panel;

said toothbrush head protector comprises an opening adjacent to said flap and substantially opposite and spaced away from said fold;

said opening being so dimensioned as to receive the head of a toothbrush and the length of said first facing panel being so dimensioned that a substantial portion of the length of the handle of the toothbrush extends from said opening when the head of the toothbrush is in contact with said fold;

said fabric having a plurality of micropores such that said fabric is substantially permeable to vapor but substantially impermeable to liquids; and said micropores being adapted so as to block at least 95% of organisms and particles larger than five microns, whereby said flap facilitates insertion of a toothbrush head into said opening;

upon insertion of a toothbrush head into said opening to said fold, the bristles of the toothbrush are covered by said fold, said first facing panel, and said second facing panel, but are exposed to the outside environment through said opening.

2. The reusable toothbrush head protector of claim 1 wherein said fabric is formed of a spunbond-meltblown-spunbond nonwoven material.

3. The reusable toothbrush head protector of claim 1 wherein said fabric is formed of a breathable film.

4. The reusable toothbrush head protector of claim 1 wherein said fabric is formed of a meltblown nonwoven material.

5. The reusable toothbrush head protector of claim 1 wherein said fabric is formed of a spunbond-meltblown nonwoven material.

6. The reusable toothbrush head protector of claim 1 wherein said fabric is substantially opaque.

7. The reusable toothbrush head protector of claim 1 wherein said fabric has a basis weight between 60 gsm and 90 gsm.

8. The reusable toothbrush head protector of claim 1 wherein said fabric is adapted to wick moisture away from the bristles of the toothbrush head.

9. A dental kit comprising a toothbrush packaged with a reusable toothbrush head protector, said toothbrush head protector comprising a generally rectangular sheet of fabric having a length that is more than two times its width;

said sheet being folded across its width to create a first facing panel and a second facing panel;

each of said first facing panel and said second facing panel having a first side edge substantially perpendicular to the fold created by said sheet being folded across its width, and a second side edge substantially parallel to said first side edge;

said first side edge of said first facing panel being bonded to said first side edge of said second facing panel;

said second side edge of said first facing panel being bonded to said second side edge of said second facing panel;

said toothbrush head protector comprises an opening substantially opposite and spaced away from said fold;

said opening being so dimensioned as to receive the head of said toothbrush and the length of said first facing panel being so dimensioned that a substantial portion of the length of the handle of said toothbrush extends from said opening when the head of said toothbrush is in contact with said fold; and said fabric being substantially permeable to vapor but substantially impermeable to liquids;

whereby upon insertion of the head of said toothbrush into said opening to said fold, the bristles of the head of said toothbrush are covered by said fold, said first facing panel, and said second facing panel, but are exposed to the outside environment through said opening.

* * * * *